United States Patent [19]

Karr et al.

[11] Patent Number: 4,620,175

[45] Date of Patent: Oct. 28, 1986

[54] SIMPLE THERMOSTAT FOR DIP MOUNTING

[75] Inventors: Dennis K. Karr, Sykesville; David A. Sprankle, Hagerstown, both of Md.

[73] Assignee: North American Philips Corporation, New York, N.Y.

[21] Appl. No.: 786,776

[22] Filed: Oct. 11, 1985

[51] Int. Cl.[4] ..... H01H 37/74

[52] U.S. Cl. ..... 337/343; 337/89; 337/347

[58] Field of Search ..... 337/343, 347, 372, 380, 337/365, 368, 89, 94

[56] References Cited

U.S. PATENT DOCUMENTS

| | | | |
|---|---|---|---|
| 3,686,605 | 8/1972 | Hire | 337/343 |
| 3,936,788 | 2/1976 | Uchiya | 337/343 |
| 4,317,097 | 2/1982 | Hofsäss | 337/343 |
| 4,517,541 | 5/1985 | Ubukata et al. | 337/343 |

*Primary Examiner*—Harold Broome

*Attorney, Agent, or Firm*—David R. Treacy

[57] ABSTRACT

A bistable bimetallic element is captured loosely between a housing cover on the one side, and an interior abutment and an end of a movable contact arm on the other side. A dimple in the housing cover provides a fulcrum for the bistable element, so as to permit a large throw of the compact arm and thus a high breakdown voltage rating.

9 Claims, 2 Drawing Figures

SIMPLE THERMOSTAT FOR DIP MOUNTING

BACKGROUND OF THE INVENTION

1. Field of the Invention

The invention relates to temperature sensing, or thermostatic, switches used for process control or as over-temperature protective devices; and more particularly to such switches adapted for mounting directly on a printed wiring or circuit board.

Advances in recent years in electronic circuits, and especially miniaturization through the use of integrated circuits which may be mounted on a wiring board or substrate, have created a great need for miniaturized transducers. At the same time, pressures for cost reduction of certain of these transducers have increased markedly. For example, at one time most thermostats were switches of a size that would customarily be picked up by an assembler or a repairman, pushed into or held on a mounting location, and attached by screws or clamps. Electrical connections were then made by attaching a flexible wire, from an external wiring harness, to a screw terminal or the like on the thermostat; or by taking an insulated flexible lead wire extending from the thermostat, and connecting it to a screw or soldered connection point. Thus the cost of installation was itself high, and the cost of a thermostat having many large parts, precisely fitted together, did not seem excessive by comparison.

In recent years automatic mounting of electronic components has become a reality, so that the cost of installation itself, on a per component basis, is relatively small. As a result much effort has been expended in the development of miniature switches and other control components and transducers. Further, it is desirable that the components be mounted mechanically by the same leads or pins which provide electrical connection. This enables installation by inserting pins through holes in a printed wiring board, arranged at standardized spacings, and then finally connected by wave soldering or some similar technique; and still more recently by surface mounting, in which contact surfaces on the outside of the unit, or short lead legs extending from the unit, rest against an electrical contact pad on the surface of a wiring board or substrate, and are directly soldered or otherwise mechanically and electrically connected to that surface, for example by the use of a conducting cement.

2. Description of the Prior Art

Where long contact life, or precise control, are desired in an electrical thermostat, for many years the preferred practice has been to use a bistable bimetallic element as the temperature sensing device. Originally such bistable elements were normally formed as a disc, which would snap relatively violently from being convex in one direction to convex in the other. When popped in a first condition, the center of the disc would bear against an element or linkage which would cause a moveable contact to be pressed, against spring force, into one switch or contact position. Upon occurrence of the predetermined temperature change, "popping" of the bimetal element to the other stable or second condition would remove the operating pressure from the linkage to the contact arm, permitting the contact arm to move to the other switch position. Thermostatic switches of this general construction could be made quite reliably and, in some instances, quite economically. However, they tend to suffer the disadvantage that, for a given size bimetallic disc diameter, only a relatively small distance of motion between the two conditions can be obtained. Therefore, unless a complicated linkage is provided to the switch contacts, only a small separation between the movable and fixed contacts could be achieved when the switch was open. As a result the voltage rating of these switches was relatively limited. Further, in some instances a relatively complex linkage was required in order to provide a good wiping action on the contacts themselves.

In order to provide a greater length of stroke from a given maximum dimension of the bistable bimetallic element, elongated bimetallic elements have been developed which offer a substantial increase in stroke when compared with a disc having a diameter equal to the length of the elongated element. Such a switch is shown in U.S. Pat. No. 4,317,097. This patent also shows an advantageous feature, in which the bimetallic element is not rigidly fixed in place at any point. This has the potential of greatly simplifying manufacture and assembly. However, the structure shown in this patent is large for a given voltage rating, and has the practical disadvantage of requiring a relatively large number of parts. Further, because of the way the bimetallic element is captured, there is no convenient way to adjust the temperature at which the switch operates, after it has been assembled.

Yet another approach to miniaturized thermostats is shown by the article "Resettable Breakers, Thermal Switches Fit DIPs," in Design News, Mar. 18, 1985, page 142. The thermostats described there are in a form which is similar to that of a dual in-line package, but are still relatively large. They appear to use a linear bimetallic spring connected through an over-center linkage to a switch contact.

SUMMARY OF THE INVENTION

An object of the invention is to provide a miniature thermostatic switch, for example of a size suitable for dual in-line packaging, with a relatively high breakdown voltage rating.

Another object of the invention is to provide a DIP mounting thermostatic switch which is both simple to assemble, but also makes it possible to adjust switching temperature after assembly.

Yet another object of the invention is to provide a more stable thermostatic switch, by which flexing of a movable contact arm provides a wiping contact action, and can absorb overtravel of the disc due either to normal tolerance build-ups or to excessive temperature change in a direction which causes the bimetallic element to bear heavily against the contact arm.

According to the invention a thermostatic switch is provided in which a switch housing has an elongated cavity in which an elongated bimetallic element is loosely captured, between a housing cover and the contact structures. The housing cover provides a fulcrum point against which a generally central portion of the bimetallic element can bear when it is in a first condition, in which a first end of the element bears against an abutment and the second end of the element pushes the contact arm, against contact arm spring force, into a first or lower position. Preferably, this first position is the switch closed condition, in which the movable contact arm is pressed toward the bottom of the housing cavity and makes contact with a fixed contact mounted at the bottom of the cavity. When the temperature changes so that the bimetallic element pops into the second condition, the contact arm moves away from the fixed contact to a second or uppermost position. In this condition the contact arm may lightly press the second end of the bimetallic element against the cover while the bimetallic element is otherwise free. Alternatively, a stop surface may be provided in the housing to limit the movement of the contact arm toward the cover, so that the bimetallic element is completely free.

Preferably, the switch and housing are constructed in a dual in-line package configuration, with the fixed contact being connected directly to an external lead extending through the side wall of the housing, and being bent downward in the typical DIP configuration. Near the other end of the package, the fixed end of the moveable contact arm is fastened against the top surface of a lead which is set into the bottom of the cavity, and also extends outward through a side wall of the housing and is bent over in the DIP configuration. Part of the housing or the attachment of the fixed end of the contact arm serves as the abutment for the first end of the bimetallic element.

To permit maximum stroke of the contact-arm-engaging end of the bimetallic element, the housing has a cover fixed in place which has a dimple near its center, the bottom surface of the dimple serving as a fulcrum for the bimetallic element. This provides maximum room for the bimetallic element to assume its second condition stable state when the switch is open. Further, if after full assembly the temperature at which the switch goes from the first condition to the second is excessively different from the temperature at which it goes from the second to the first condition, the differential temperature can be reduced by increasing the depth of the dimple.

In still another embodiment of the invention, the free end of the contact arm extends a short distance beyond the contact, and is preferably bent toward the bimetallic element. This second bend provides sufficient clearance to permit the movable contact arm to flex substantially when the contact makes, thereby providing a wiping action. The reverse of this action, upon contact opening, will tend to break any "tack welds" if they occurred during closure. Further, in the event of further temperature change or tolerance build-up causing a greater deformation of the bimetallic element while in this condition, the additional flexing permitted by the clearance due to this second bend can absorb the overtravel of the bimetallic element.

DESCRIPTION OF THE PREFERRED EMBODIMENTS

Figure 1:
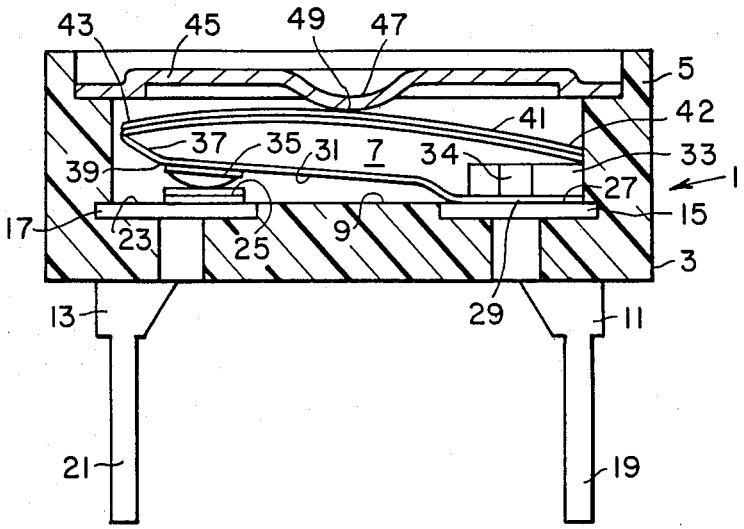
FIG. 1 is a sectional elevation of a switch according to the invention.
Figure 2:
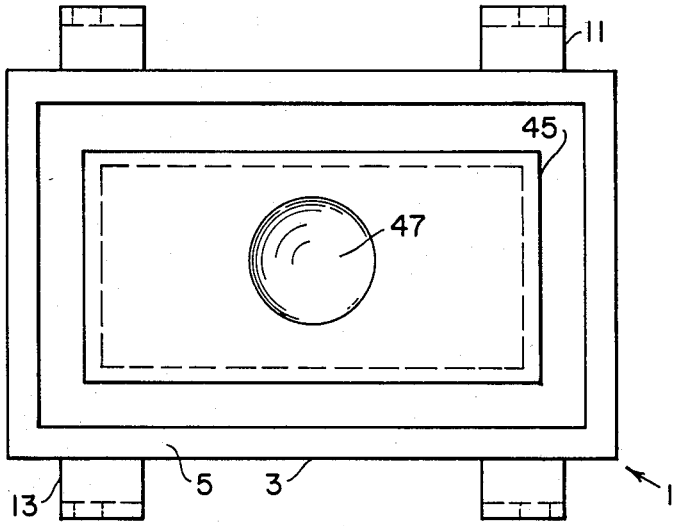
FIG. 2 is a plan view of the switch of FIG. 1.

The thermostatic switch shown in FIGS. 1 and 2 is an embodiment of the invention especially adapted for standard DIP (dual-inline package) mounting. The switch assembly 1 has a housing 3, made of any suitable plastic material, having side and end walls 5 defining a cavity 7 having a bottom 9.

Molded in place in the housing 3 are a dual terminal member 11, and a dual terminal assembly 13. The terminal member 11 has an inner part 15 and two pin ends 19. The dual terminal assembly 13 has an inner part 17 and pin ends 21. The terminal member 11 and the terminal assembly 13, at points located just beyond where they pass through the housing wall on each side, are bent so that their respective pin ends are separated from each other by a standard DIP pin spacing.

The inner part 17 of assembly 13 has an exposed surface 23 on which a fixed contact 25 is mounted, preferably prior to molding of the housing 3. Similarly, the inner part 15 of the terminal member 11 has an exposed surface 27, to which the fixed end 29 of a contact arm 31 is welded. Preferably, protruding portions 33 of the housing 3, each having a locating rib 34, are arranged to permit pressing of the fixed end 29 into place between the portions prior to spot welding the end 29 to the inner part 15. This portion 33 also serves an abutment function, to be described below.

A movable contact 35 is fixed near the free end 37 of the movable contact arm 31, and is separated from the end by a bend 39 which, as described below, provides advantageous clearance for flexing of the arm 31.

A bistable bimetallic element 41 is arranged to be a loose fit in the cavity 7 between the walls 5. The element 41, as is well known, is typically made with a slightly dished configuration so that it will pop, as a function of temperature, from a first condition shown in FIG. 1, to a second condition in which it has a reverse bow. In the first condition, shown in FIG. 1, the first end of the element 41 bears against the portion 33 or abutment adjacent the terminal member 11 while a second end 43 of the element 41 bears against the free end 37 of the contact arm 31. The necessary restraint, to permit the bimetallic element to press against the contact arm, is provided by an aluminum cover 45, which is staked in place into the housing 3. A dimple 47 formed in the cover 43 serves as a fulcrum 49 for the element 41.

The shape of the contact arm 31 permits the bimetal element 41 to bow to a greater extent than that shown in FIG. 1, especially when tolerance build-up or excessive temperature change causes the bimetal element to curve more strongly. Under these conditions, the contact arm 31 will bend into an "S" shape, as a result of which the free end 37 will be moved downward toward the bottom of the cavity, and the movable contact 35 will slide along the fixed contact 25, thereby providing a useful wiping action.

Those of ordinary skill in the art will recognize that the bimetallic element 41 will pop from the second condition, opposite to that shown in FIG. 1, to the FIG. 1 condition at a temperature which is determined by its construction and configuration. However, the differential between this temperature, and that at which the element 41 pops back from the position shown in FIG. 1, may be adjusted by varying the amount of loading on the element 41 while it is in the position shown in FIG. 1. This is accomplished by increasing the depth of the dimple 47. This may be conveniently performed by pressing inward on the dimple portion, after assembly of the thermostatic switch has been completed. To prevent subsequent tampering, the cover 43 may subsequently be covered with a layer of plastic material, such as an epoxy resin.

As can be seen clearly from FIG. 1, the fact that the ends of the bimetallic element 41 are free allows maximum movement or throw of the contact arm 31 even if the element is strongly bowed in the opposite direction. This maximizes the voltage rating obtainable in a given switch. For example, a 48 volt DC rating is obtainable in a switch having pin spacings of $0.300 \times 0.325$ inches (7.6×8.3 mm) in a housing only 0.13 inches (3.3 mm) high.

Many minor variations upon this preferred embodiment may be made for particular applications. For example, if the exposed surface of the cover 45 is not adequately protected by a layer of insulating material such as a resin, either the lower surface of the cover and dimple or one of the surfaces of the bimetallic element 41 may be covered with an insulating layer. At some loss of compactness and simplicity, a second fixed contact can be added, which will be engaged by the end of the contact arm 31 when it has moved up, away from the bottom 9 of the cavity 7. This would provide a single pole double throw construction.

To permit surface mounting of the thermostat, instead of DIP terminal and pin assemblies, connections can be provided through the housing wall or bottom from the inner parts 15 and 17 to leads or connection pads on the underneath surface of the housing 3. Thus the scope of the invention, as measured by the appended claims, extends to these and other variations as well.

What is claimed:

1. A thermostatic switch comprising:

a housing having a cavity defined by walls, a first contact and a movable second contact, each disposed in said cavity, first means, for making respective external electrical connections to said first and second contacts, and second means, for biasing said second contact against, and alternatively moving said second contact in a movement direction away from, said first contact as a function of ambient temperature; said second means comprising an elongated bistable bimetallic element having two ends and defining an elongation direction and a width direction transverse to the elongation direction and said movement direction, and a contact arm, said second contact being disposed on said contact arm adjacent a free end thereof, characterized in that said cavity is an elongated cavity having first and second ends and a bottom, said housing includes an abutment surface at said second end of said elongated cavity, said switch further comprises a cover fixed to said housing over said cavity, said cover having a fulcrum point thereon, and said bimetallic element is arranged loose in said cavity, with a small clearance in the elongation direction and the width direction, arranged such that in a first stable condition one end of said element bears against said abutment, the other end bears against said contact arm free end so as to hold the contact arm in a stressed condition adjacent the bottom of the cavity, and intermediate said ends the element bears against said fulcrum; and in a second stable condition said one end is substantially free of said abutment, and said other end and said contact arm free end are moved toward said cover and away from said first contact.

2. A switch as claimed in claim 1, characterized in that said first contact is a fixed contact mounted at the bottom of said cavity adjacent the cavity first end; and said contact arm has a fixed end opposite said free end, and means for fixing said fixed end to said housing adjacent said second end of said cavity, said means for fixing forming said abutment.

3. A switch as claimed in claim 2, characterized in that said fulcrum point is a dimple formed in said cover, depth of said dimple being selected to adjust an operating temperature of the thermostatic switch.

4. A switch as claimed in claim 2, characterized in that said second contact is disposed between said fixed end and a location at which the bimetallic element bears against said free end, whereby flexing of the contact arm provides a contact wiping action.

5. A simple-construction thermostatic switch for simplified mounting, comprising:

a housing having a cavity defined by walls, a first contact and a movable second contact, each disposed in said cavity, first means, for making respective external electrical connections to said first and second contacts, and second means, for biasing said second contact against, and alternatively moving said second contact in a movement direction away from, said first contact as a function of ambient temperature; said second means comprising an elongated bistable bimetallic element having two ends and defining an elongation direction and a width direction transverse to the elongation direction and said movement direction, and a contact arm, said second contact being disposed on said contact arm adjacent a free end thereof, characterized in that said cavity is an elongated cavity having first and second ends and a bottom, said first contact is a fixed contact mounted at the bottom of said cavity adjacent the cavity first end; said contact arm has a fixed end opposite said free end, said fixed end being mounted at the bottom of said cavity adjacent the cavity second end; and said first means comprises respective means for fixing said first contact and said contact arm fixed end to the housing, and respective connection means projecting from said housing and arranged to provide both mechanical mounting of and electrical connection to said switch, said housing includes an abutment surface at an end of said elongated cavity, said switch further comprises a cover fixed to said housing over said cavity, said cover having a fulcrum point thereon, and said bimetallic element is arranged loose in said cavity, with a small clearance in the elongation direction and the width direction, arranged such that in a first condition one end of said element bears against said abutment, and the other end bears against said contact arm free end so as to hold the contact arm in a stressed condition adjacent the bottom of the cavity, and intermediate said ends the element bears against said fulcrum; and in a second condition said one end is substantially free of said abutment, and said other end and said contact arm free end are moved toward and adjacent said cover.

6. A switch as claimed in claim 5, characterized in that said fulcrum point is a dimple formed in said cover, depth of said dimple being selected to adjust the operating temperature of the thermostatic switch.

7. A switch as claimed in claim 6, characterized in that said respective connection means each comprise a bent member, having an inner part fixed in the housing and having an exposed surface against which the respective contact or contact arm are fixed, extending through a respective wall of said housing, and a pin end arranged for DIP mounting.

8. A switch as claimed in claim 5, characterized in that said respective connection means each comprise a bent member, having an inner part fixed in the housing and having an exposed surface against which the respective contact or contact arm are fixed, extending through a respective wall of said housing, and a pin end arranged for DIP mounting.

9. A switch as claimed in claim 5, characterized in that said second contact is disposed between said fixed end and a location at which the bimetallic element bears against said free end, whereby flexing of the contact arm provides a contact wiping action.

* * * * *